US011404194B2

(12) United States Patent
Imazu et al.

(10) Patent No.: US 11,404,194 B2
(45) Date of Patent: Aug. 2, 2022

(54) TRANSFORMER

(71) Applicant: Mitsubishi Electric Corporation, Tokyo (JP)

(72) Inventors: Takayuki Imazu, Tokyo (JP); Keita Tonoike, Tokyo (JP); Katsutoshi Okada, Tokyo (JP); Hiroshi Kinoshita, Tokyo (JP); Yoshinobu Kitagawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 343 days.

(21) Appl. No.: 16/753,010

(22) PCT Filed: Jan. 17, 2018

(86) PCT No.: PCT/JP2018/001155
§ 371 (c)(1),
(2) Date: Apr. 2, 2020

(87) PCT Pub. No.: WO2019/142250
PCT Pub. Date: Jul. 25, 2019

(65) Prior Publication Data

US 2020/0294700 A1 Sep. 17, 2020

(51) Int. Cl.
*H01F 27/02* (2006.01)
*H01F 27/24* (2006.01)
*H01F 27/28* (2006.01)

(52) U.S. Cl.
CPC ..... *H01F 27/02* (2013.01); *H01F 27/24* (2013.01); *H01F 27/28* (2013.01)

(58) Field of Classification Search
CPC ..... H01F 27/02; H01F 27/24; H01F 27/28; H01F 27/266; H01F 27/002; H01F 27/06; H01F 27/14
See application file for complete search history.

(56) References Cited

U.S. PATENT DOCUMENTS

2016/0245238 A1* 8/2016 Ueda ..... F02M 25/0854
2018/0158596 A1* 6/2018 Cardona ..... F16K 17/196

FOREIGN PATENT DOCUMENTS

JP S58196812 U 12/1983
JP S6165732 U 5/1986
JP S6247111 U 3/1987

OTHER PUBLICATIONS

International Search Report (PCT/ISA/210), with translation, and Written Opinion (PCT/ISA/237) dated Feb. 20, 2018, by the Japan Patent Office as the International Searching Authority for International Application No. PCT/JP2018/001155.

* cited by examiner

*Primary Examiner* — Jared Fureman
*Assistant Examiner* — Michael J Warmflash
(74) *Attorney, Agent, or Firm* — Buchanan Ingersoll & Rooney PC

(57) ABSTRACT

A transformer includes a transformer body, a tank, a conservator, a plurality of support fittings, and at least one mounting seat. Transformer body includes an iron core and a winding. Tank includes an upper tank, a middle tank, and a lower tank that are bonded together to form an internal space accommodating transformer body. Conservator is arranged at a position above tank. The plurality of support fittings are arranged side by side at intervals to support conservator. At least one mounting seat is bonded to both a peripheral wall of upper tank and a peripheral wall of middle tank, and fixed to tank, and the plurality of support fittings are attached.

8 Claims, 9 Drawing Sheets

TRANSFORMER

TECHNICAL FIELD

The present invention relates to a transformer, more particularly to a transformer including a conservator.

BACKGROUND ART

Utility Model Laying-Open No. 58-196812 (PTL 1) is a prior document that discloses a configuration of the transformer including the conservator. In the transformer described in PTL 1, the conservator is supported by a support fitting attached to a sidewall in a longitudinal direction of a main body tank at a position higher than an upper surface of the main body tank in order to secure an insulating distance from a bushing.

CITATION LIST

Patent Literature

PTL 1: Utility Model Laying-Open No. 58-196812

SUMMARY OF INVENTION

Technical Problem

Because an instrument is disposed on a sidewall of the tank to which the support fitting is attached while a seam of the tank is located, the large support bracket in a height direction or a width direction is hardly attached to the sidewall of the tank. For this reason, strength necessary to support the conservator is secured by connecting many beam members to the support fitting.

The large-size transformer is transported to an installation location of the transformer while the transformer is disassembled into a size that can be transported, and is assembled at the installation place. When the conservator is supported by the support fitting to which many beam members are connected, it is necessary to connect many beam members to the support fitting at the installation location of the transformer, and the assembling time of the transformer is lengthened.

The present invention has been made in view of the above-described problems, and a large sectional area of the support fitting is enlarged to enhance the strength of the support fitting by enabling the large support fitting in the height direction and the width direction to be attached to the sidewall of the tank, so that the number of beams connected to the support fitting can be decreased. As a result, the assembling time of the transformer can be shortened at the installation location.

Solution to Problem

According to one aspect of the present invention, a transformer includes a transformer body, a tank, a conservator, a plurality of support fittings, and at least one mounting seat. The transformer body includes an iron core and a winding. The tank includes an upper tank, a middle tank, and a lower tank, which are bonded to one another to constitute an internal space accommodating the transformer body. The conservator is disposed at a position above the tank. The plurality of support fittings are arranged side by side at intervals to support the conservator. At least one mounting seat is bonded to both a peripheral wall of the upper tank and a peripheral wall of the middle tank and fixed to the tank, and a plurality of support fittings being attached to the mounting seat.

Advantageous Effects of Invention

According to the present invention, the mounting seat is bonded to both the peripheral wall of the upper tank and the peripheral wall of the middle tank and fixed to the tank, and the support fitting is attached to the mounting seat to relief an influence of a joint of the tank and a layout of an instrument, which allows the large support fitting in at least one of the height direction and the width direction to be attached to the peripheral wall of the tank. Consequently, the strength of the support fitting can be enhanced by enlarging the sectional area of the support fitting, so that the number of beams connected to the support fitting can be decreased. As a result, the assembling time of the transformer can be shortened at the installation location.

DESCRIPTION OF EMBODIMENTS

Figure 1:
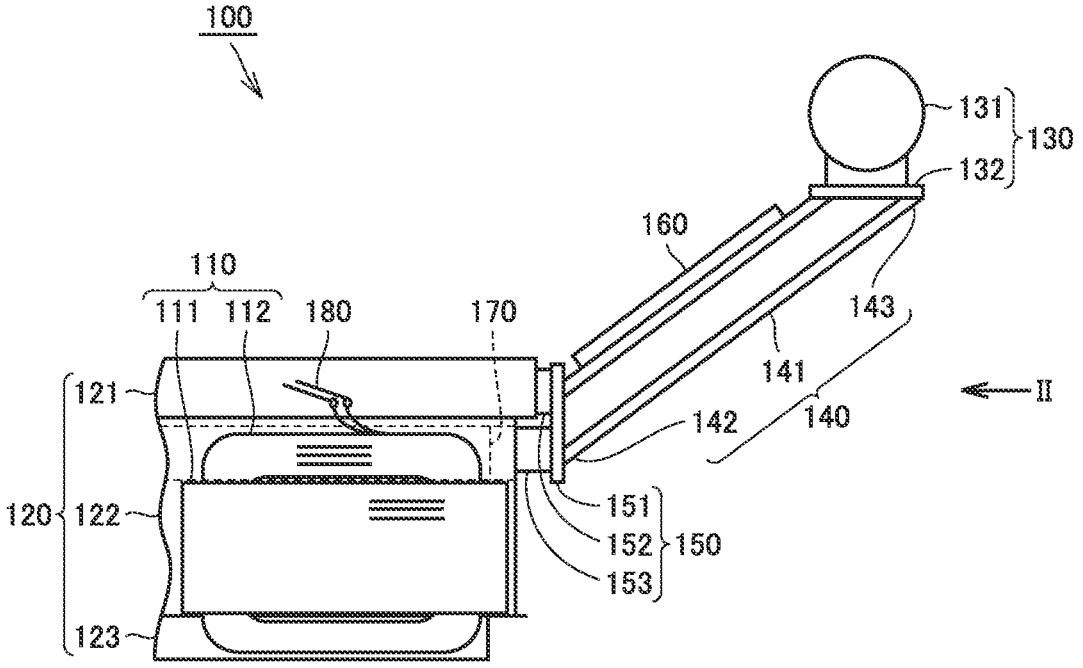
FIG. 1 is a partial front view illustrating a configuration of a transformer according to a first embodiment of the present invention.

Hereinafter, a transformer according to each embodiment of the present invention will be described with reference to the drawings. In the following description of the embodiments, the same or corresponding portions in the drawings are denoted the same reference numeral, and the description will not be repeated.

First Embodiment

Figure 2:
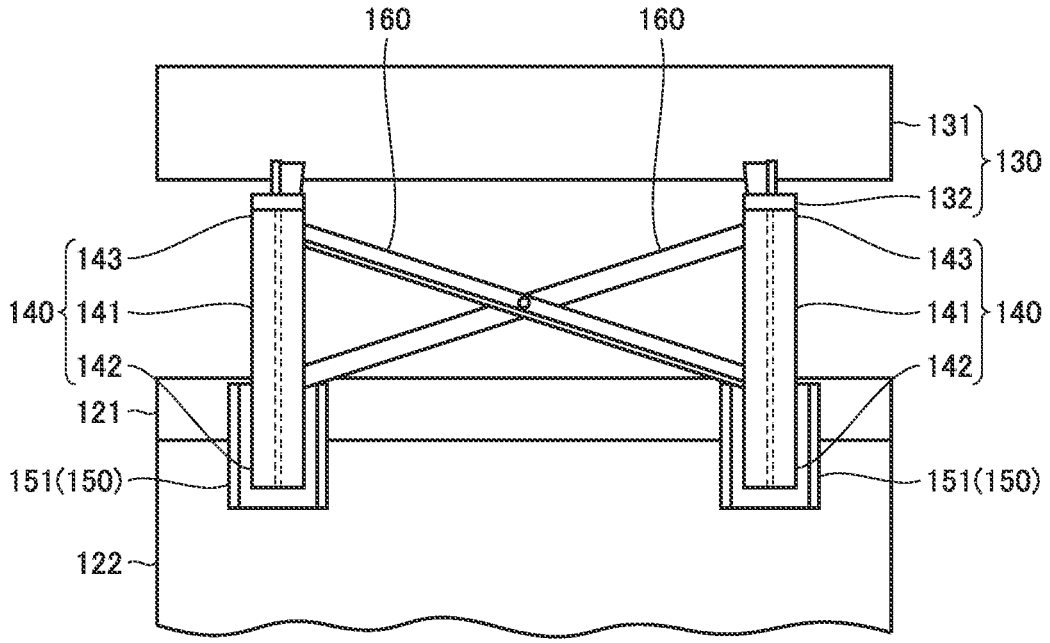
FIG. 2 is a partial side view illustrating the transformer in FIG. 1 as viewed from a direction of an arrow II.

FIG. 1 is a partial front view illustrating a configuration of a transformer according to a first embodiment of the present invention. FIG. 2 is a partial side view illustrating the transformer in FIG. 1 as viewed from a direction of an arrow II. In FIG. 1, a transformer body is illustrated by seeing through a middle tank and a lower tank.

As illustrated in FIGS. 1 and 2, a transformer 100 of the first embodiment of the present invention includes a transformer body 110, a tank 120, a conservator 130, two support fittings 140, and two mounting seats 150. However, the number of support fittings 140 is not limited to two, but may be three or more. The number of mounting seats 150 is not limited to two, but may be one or three or more.

Transformer 100 of the first embodiment is a shell type transformer. Transformer body 110 includes an iron core 111 and a winding 112. Winding 112 is wound around a leg of iron core 111. Iron core 111 is formed of a plurality of laminated electromagnetic steel sheets. A lead drawn out from an upper portion of winding 112 is connected to an external lead 180 with a bushing (not illustrated) interposed therebetween.

Tank 120 includes an upper tank 121, a middle tank 122, and a lower tank 123. Upper tank 121, middle tank 122, and lower tank 123 are bonded together to form an internal space accommodating transformer body 110. An inside of tank 120 is filled with insulating oil. Transformer body 110 is immersed in the insulating oil.

Iron core 111 is sandwiched and fixed between an iron core presser 170 and a flange of lower tank 123. Iron core presser 170 is bonded to an inner peripheral surface in an upper portion of a peripheral wall of middle tank 122. For this reason, the upper portion of the peripheral wall of middle tank 122 has strength higher than other portions of the peripheral wall of middle tank 122.

Conservator 130 is disposed above tank 120. Conservator 130 includes a conservator body 131 and a leg 132. Conservator body 131 and tank 120 are connected to each other by an oil passage (not illustrated) serving as a passage of the insulating oil. Conservator 130 is supported by two support fittings 140 arranged side by side at an interval from each other.

Figure 3:
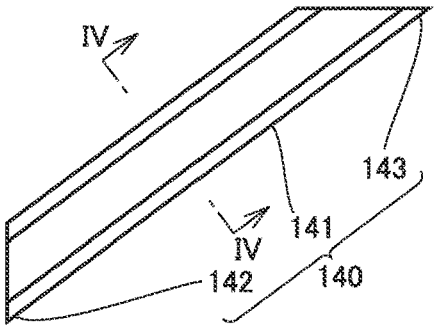
FIG. 3 is a front view illustrating a configuration of a support fitting included in the transformer of the first embodiment of the present invention.
Figure 4:
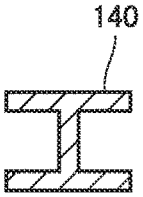
FIG. 4 is a sectional view illustrating the support fitting taken along a line IV-IV in FIG. 3.

FIG. 3 is a front view illustrating a configuration of the support fitting included in the transformer of the first embodiment of the present invention. FIG. 4 is a sectional view illustrating the support fitting taken along a line IV-IV in FIG. 3.

As illustrated in FIGS. 1 to 4, each of two support fittings 140 includes a main unit 141, a lower end 142, and an upper end 143. In the first embodiment, each of two support fittings 140 is made of H-shaped steel, and disposed in an inclined state. Two support fittings 140 are integrated by connecting a brace 160 made of two L-shaped steels to the upper portion of main unit 141.

Upper end 143 of support fitting 140 includes an end face extending in a horizontal direction, and is connected to leg 132 of conservator 130. Lower end 142 of support fitting 140 includes an end face extending in a vertical direction, and is connected to mounting seat 150. In the first embodiment, two support fittings 140 are attached to two mounting seats 150 in a one-to-one manner.

Figure 5:
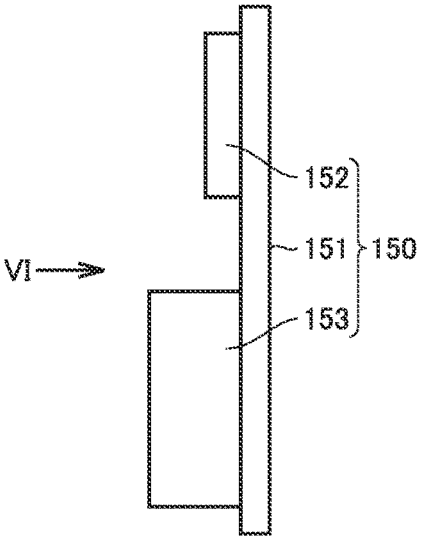
FIG. 5 is a front view illustrating a configuration of the mounting seat provided in the transformer of the first embodiment of the present invention.
Figure 6:
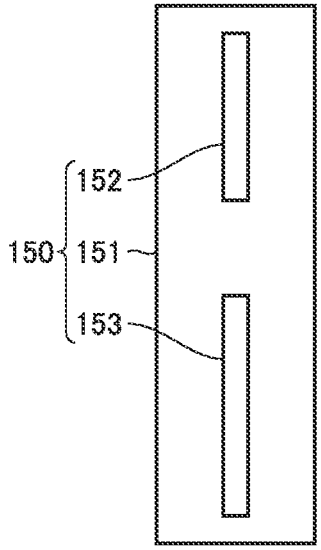
FIG. 6 is a side view illustrating the mounting seat in FIG. 5 as viewed from a direction of an arrow VI.
Figure 7:
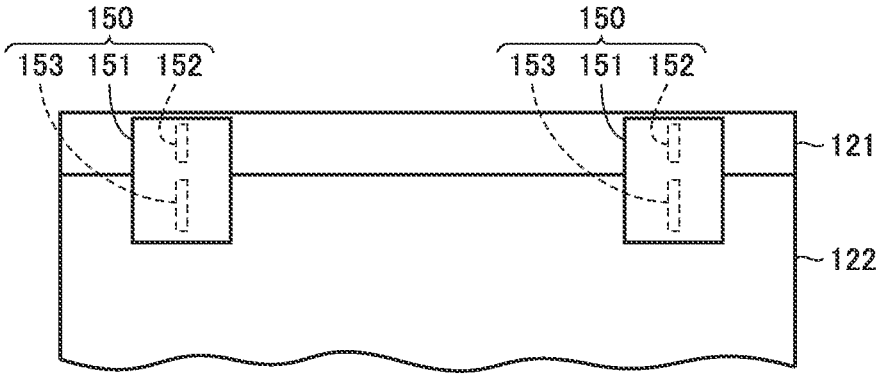
FIG. 7 is a partial side view illustrating a state before the support fitting is attached to the mounting seat in the transformer of the first embodiment of the present invention.

FIG. 5 is a front view illustrating a configuration of the mounting seat included in the transformer of the first embodiment of the present invention. FIG. 6 is a side view illustrating the mounting seat in FIG. 5 as viewed from a direction of an arrow VI. FIG. 7 is a partial side view illustrating a state before the support fitting is attached to the mounting seat in the transformer of the first embodiment of the present invention. In FIG. 7, the state is illustrated as viewed from the same direction as FIG. 2.

As illustrated in FIGS. 1, 2, 5 to 7, mounting seat 150 includes a flat plate 151 and a leg. Flat plate 151 contacts with lower end 142 of support fitting 140. Flat plate 151 is bonded to lower end 142 of support fitting 140 by welding when transformer 100 is assembled at an installation location.

The leg of mounting seat 150 includes an upper leg 152 and a lower leg 153. However, the leg of mounting seat 150 may integrally be formed. Upper leg 152 and lower leg 153 are provided upright from an opposite side to a side contacting with support fitting 140 with respect to flat plate 151. Upper leg 152 and lower leg 153 are disposed apart from each other in the vertical direction. A shape of each of upper leg 152 and lower leg 153 is a rectangular parallelepiped having a longitudinal direction along the vertical direction.

Upper leg 152 contacts with the peripheral wall of upper tank 121. Lower leg 153 contacts with the peripheral wall of middle tank 122. Thus, the leg of mounting seat 150 contacts with both the peripheral wall of upper tank 121 and the peripheral wall of middle tank 122.

In the first embodiment, each of flat plate 151, upper leg 152, and lower leg 153 is made of a steel material. Each of upper leg 152 and lower leg 153 and flat plate 151 are bonded to each other by welding. Mounting seat 150 may be formed of one member by casting or cutting.

A dimension in a height direction of flat plate 151 is larger than a dimension in the height direction of a sum of upper leg 152 and lower leg 153. A dimension in a width direction of flat plate 151 is larger than the dimension in the width direction of a sum of upper leg 152 and lower leg 153.

Upper leg 152 is bonded to the peripheral wall of upper tank 121 by welding. Lower leg 153 is bonded to the peripheral wall of middle tank 122 by welding. As described above, two mounting seats 150 are bonded to both the peripheral wall of upper tank 121 and the peripheral wall of middle tank 122, and fixed to tank 120.

In the first embodiment, each of two mounting seats 150 faces iron core presser 170 with the peripheral wall of middle tank 122 interposed therebetween. Specifically, lower leg 153 of each of two mounting seats 150 is bonded to an outer peripheral surface in the upper portion of the peripheral wall of middle tank 122 to which iron core presser 170 is bonded.

A method for assembling transformer 100 of the first embodiment of the present invention will be described below.

After lower tank 123 is disposed, iron core 111 and winding 112 are disposed inside lower tank 123. Subsequently, by disposing middle tank 122 on lower tank 123, iron core 111 is sandwiched and fixed between iron core presser 170 and the flange of lower tank 123. After that, the leads drawn out from the upper portion of winding 112 and external lead 180 connecting the outside of transformer 100 are connected to each other.

Subsequently, upper tank 121 is disposed on middle tank 122. Thereafter, upper tank 121, middle tank 122, and lower tank 123 are bonded to one another. Subsequently, upper leg 152 is bonded to the peripheral wall of upper tank 121, and lower leg 153 is bond to the peripheral wall of middle tank 122, whereby mounting seat 150 is fixed to tank 120.

Thereafter, as illustrated in FIG. 7, transformer 100 is transported to an installation location before support fitting 140 is attached to mounting seat 150. At the installation location, two support fittings 140 are attached to two mounting seats 150, and two support fittings 140 are connected to each other by brace 160. Subsequently, conservator 130 is disposed on upper end 143 of support fitting 140, and leg 132 of conservator 130 and upper end 143 of support fitting 140 are connected to each other.

In transformer 100 of the first embodiment of the present invention, mounting seat 150 is bonded to both the peripheral wall of upper tank 121 and the peripheral wall of middle tank 122 and fixed to tank 120, and support fitting 140 is attached to mounting seat 150 to relief an influence of a layout of an instrument and a joint of tank 120, which allows large support fitting 140 in at least one of the height direction and the width direction to be attached to the peripheral wall of tank 120. Consequently, strength of support fitting 140 can be enhanced by enlarging a sectional area of support fitting 140, so that the number of beams connected to support fitting 140 can be decreased. As a result, time required for assembly of transformer 100 at the installation location can be shortened.

In the first embodiment, lower leg 153 of mounting seat 150 is bonded to the upper portion of the peripheral wall of middle tank 122 in which the strength is enhanced by bonding iron core presser 170, so that support fitting 140 is enlarged to be able to support heavier conservator 130.

Mounting seat 150 includes flat plate 151 and the leg contacting with both the peripheral wall of upper tank 121 and the peripheral wall of middle tank 122, so that support fitting 140 can stably be attached to mounting seat 150 while mounting seat 150 and tank 120 are stably be bonded together.

A weight of mounting seat 150 can be reduced by attaching the plurality of support fittings 140 to the plurality of mounting seats 150 in a one-to-one manner, and thus a weight of transformer 100 can be reduced.

Second Embodiment

A transformer according to a second embodiment of the present invention will be described below with reference to the drawings. Because the transformer of the second embodiment of the present invention differs from transformer 100 of the first embodiment of the present invention only in the configuration of the mounting seat, the description of same configuration as transformer 100 of the first embodiment of the present invention will not be repeated.

Figure 8:
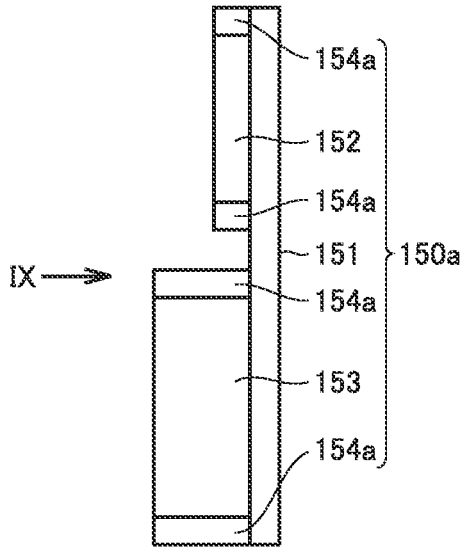
FIG. 8 is a front view illustrating a configuration of the mounting seat included in a transformer according to a second embodiment of the present invention.
Figure 9:
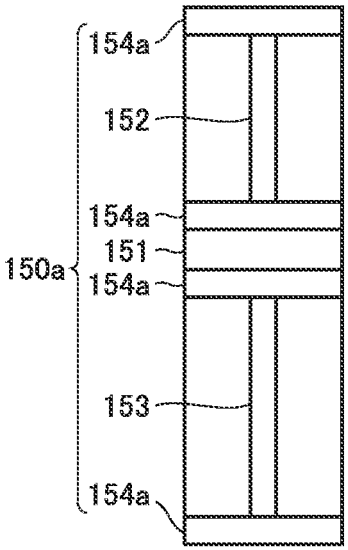
FIG. 9 is a side view illustrating the mounting seat in FIG. 8 as viewed from a direction of an arrow IX.

FIG. 8 is a front view illustrating the configuration of the mounting seat included in the transformer of the second embodiment of the present invention. FIG. 9 is a side view illustrating the mounting seat in FIG. 8 as viewed from a direction of an arrow IX.

As illustrated in FIGS. 8 and 9, a mounting seat 150*a* included in the transformer of the second embodiment of the present invention includes flat plate 151 and the leg. The leg of mounting seat 150*a* includes upper leg 152 and lower leg 153. Mounting seat 150*a* further includes a rib 154*a* protruding from flat plate 151 toward the opposite side to the side contacting with support fitting 140.

In the second embodiment, ribs 154*a* extending in the width direction of flat plate 151 is provided at positions of both ends in the height direction of each of upper leg 152 and lower leg 153. Rib 154*a* has a rectangular parallelepiped shape, and is bonded to flat plate 151 by welding. The shape and the layout of rib 154*a* are not limited to the above configuration, but it is only necessary to protrude from flat plate 151 toward the opposite side to the side contacting with support fitting 140. Flat plate 151 and rib 154*a* may be formed of one member.

When mounting seat 150*a* further includes rib 154*a*, the strength of mounting seat 150*a* can be enhanced. Support fitting 140 is enlarged by enhancing the strength of mounting seat 150*a*, which allows heavier conservator 130 to be supported. Additionally, the weight of mounting seat 150*a* can be reduced, and thus the weight of the transformer can be reduced.

Third Embodiment

A transformer according to a third embodiment of the present invention will be described below with reference to the drawings. Because the transformer of the third embodiment of the present invention differs mainly from the transformer of the second embodiment of the present invention in that the support fitting is detachably attached to the mounting seat, the description of the same configuration as the transformer of the second embodiment will not be repeated.

Figure 10:
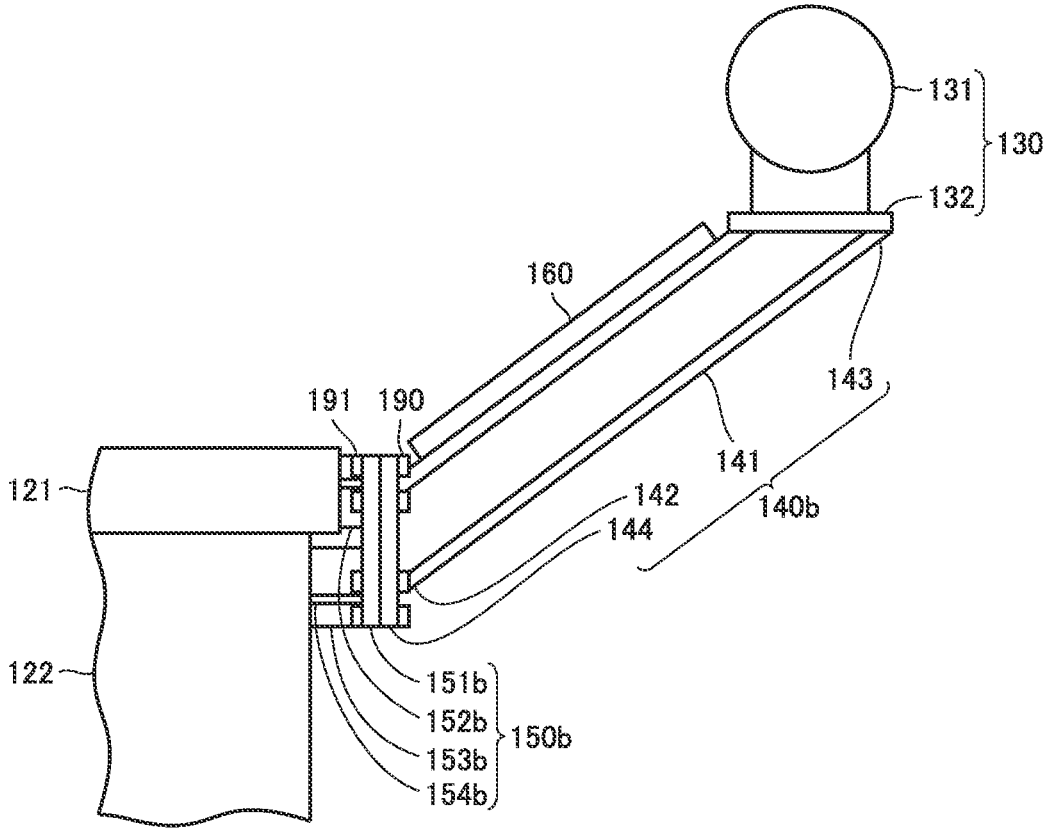
FIG. 10 is a partial front view illustrating a configuration of a transformer according to a third embodiment of the present invention.
Figure 11:
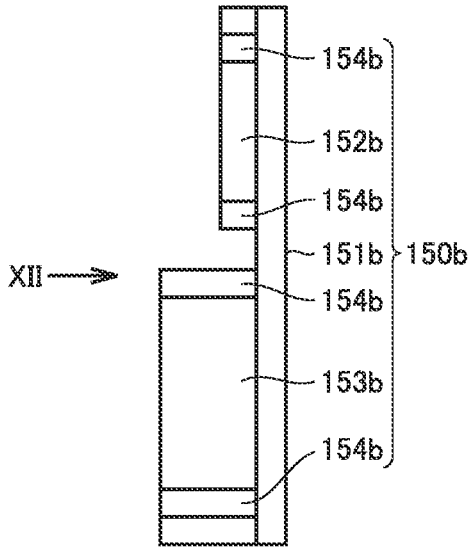
FIG. 11 is a front view illustrating a configuration of the mounting seat included in a transformer of the third embodiment of the present invention.
Figure 12:
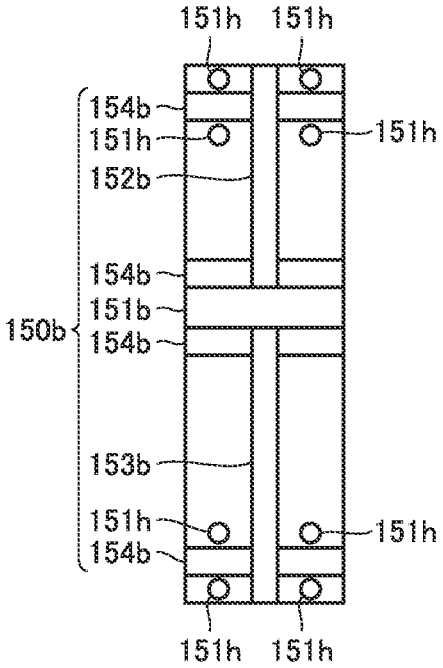
FIG. 12 is a side view illustrating the mounting seat in FIG. 11 as viewed from a direction of an arrow XII.

FIG. 10 is a partial front view illustrating a configuration of the transformer of the third embodiment of the present invention. FIG. 11 is a front view illustrating a configuration of the mounting seat included in a transformer of the third embodiment of the present invention. FIG. 12 is a side view illustrating the mounting seat in FIG. 11 as viewed from a direction of an arrow XII.

As illustrated in FIGS. 10 to 12, in the transformer of the third embodiment of the present invention, a support fitting 140*b* is detachably attached to a mounting seat 150*b*. In the third embodiment, support fitting 140*b* and mounting seat 150*b* are connected to each other by bolt 190 and nut 191.

Specifically, support fitting 140*b* includes main unit 141, lower end 142, upper end 143, and flat plate 144 bonded to lower end 142. Eight through-holes (not illustrated) through each of which bolt 190 is inserted are made in flat plate 144.

Mounting seat 150*b* includes a flat plate 151*b* and a leg. Flat plate 151*b* contacts with flat plate 144 of support fitting 140*b*. The leg of mounting seat 150*b* includes upper leg 152*b* and lower leg 153*b*. Upper leg 152*b* and lower leg 153*b* are provided upright from the opposite side to the side contacting with support fitting 140*b* with respect to flat plate 151*b*. Upper leg 152*b* and lower leg 153*b* are disposed apart from each other in the vertical direction. The shape of each of upper leg 152*b* and lower leg 153*b* is a rectangular parallelepiped having the longitudinal direction along the vertical direction.

Upper leg 152*b* contacts with the peripheral wall of upper tank 121. Lower leg 153*b* contacts with the peripheral wall of middle tank 122. Thus, the leg of mounting seat 150*b* contacts with both the peripheral wall of upper tank 121 and the peripheral wall of middle tank 122. Each of upper leg 152*b* and lower leg 153*b* and flat plate 151*b* are bonded to each other by welding.

Mounting seat 150*b* further includes a rib 154*b* protruding from flat plate 151*b* toward the opposite side to the side contacting with support fitting 140*b*. Rib 154*b* extending in the width direction of flat plate 151*b* is provided at positions of both sides of both ends in the height direction of each of upper leg 152*b* and lower leg 153*b*. Rib 154*b* has a rectangular parallelepiped shape, and is bonded to flat plate 151 by welding. Mounting seat 150*b* may be formed of one member by casting or cutting.

Eight through-holes 151*h* into each of which bolt 190 is inserted are made in flat plate 151*b*. When viewed from a direction orthogonal to flat plate 151*b*, each of four ribs 154*b* located at both ends in the height direction of flat plate 151*b* is sandwiched between two through-holes 151*h* in the height direction.

Upper leg 152*b* is bonded to the peripheral wall of upper tank 121 by welding. Lower leg 153*b* is bonded to the peripheral wall of middle tank 122 by welding. In this way, mounting seat 150*b* is bonded to both the peripheral wall of upper tank 121 and the peripheral wall of middle tank 122, and fixed to tank 120.

Support fitting 140*b* is detachably attached to mounting seat 150*b* by screwing nut 191 and bolt 190 inserted through the through-hole of flat plate 144 of support fitting 140*b* and through-hole 151*h* of flat plate 151*b* of mounting seat 150*b*.

However, the method for connecting support fitting 140*b* and mounting seat 150*b* is not limited to the screwing of bolt 190 and nut 191. For example, a female screw screwed with bolt 190 is formed in flat plate 151*b* of mounting seat 150*b*, and support fitting 140*b* may detachably be attached to mounting seat 150*b* by screwing the female screw with bolt 190 inserted through the through-hole of flat plate 144 of support fitting 140*b*.

The female screw may be formed in flat plate 144 of support fitting 140*b*. In this case, support fitting 140*b* can detachably be attached to mounting seat 150*b* by screwing bolt 190 inserted through through-hole 151*h* of flat plate 151*b* of mounting seat 150*b* in the female screw formed in flat plate 144 of support fitting 140*b*.

A series of operations can be facilitated as follows. Support fitting 140*b* is detachably attached to mounting seat 150*b* before the transformer is transported to the installation location, a finished goods inspection of the transformer is performed with conservator 130 disposed, and the transformer in the state in which support fitting 140*b* is removed from mounting seat 150*b* is transported to the installation location to reassemble the transformer at the installation location. As a result, the assembling time of the transformer can be shortened at the installation location.

Fourth Embodiment

A transformer according to a fourth embodiment of the present invention will be described below with reference to the drawings. The transformer of the fourth embodiment of the present invention differs mainly from the transformer of the third embodiment of the present invention in that a plurality of support fittings are attached to one mounting seat, and that the transformer includes an engagement unit that positions the support fitting and the mounting seat. For this reason, the description of the same configuration as the transformer of the third embodiment of the present invention will not be repeated.

Figure 13:
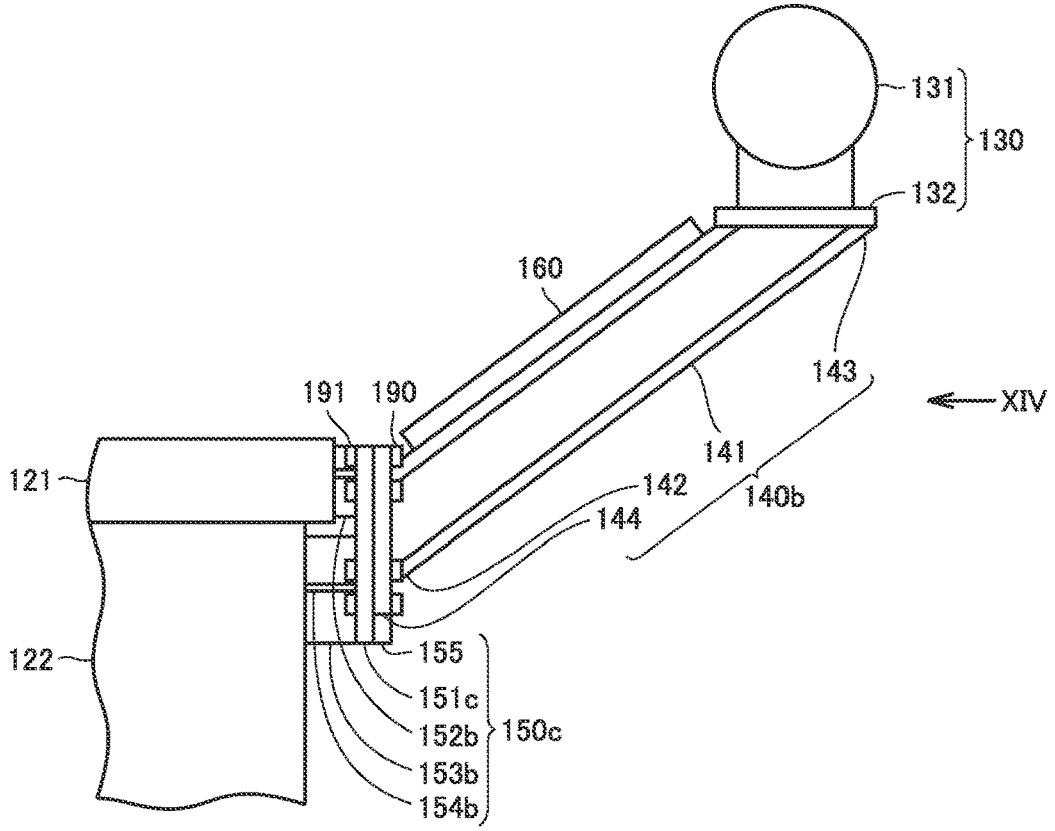
FIG. 13 is a partial front view illustrating a configuration of a transformer according to a fourth embodiment of the present invention.
Figure 14:
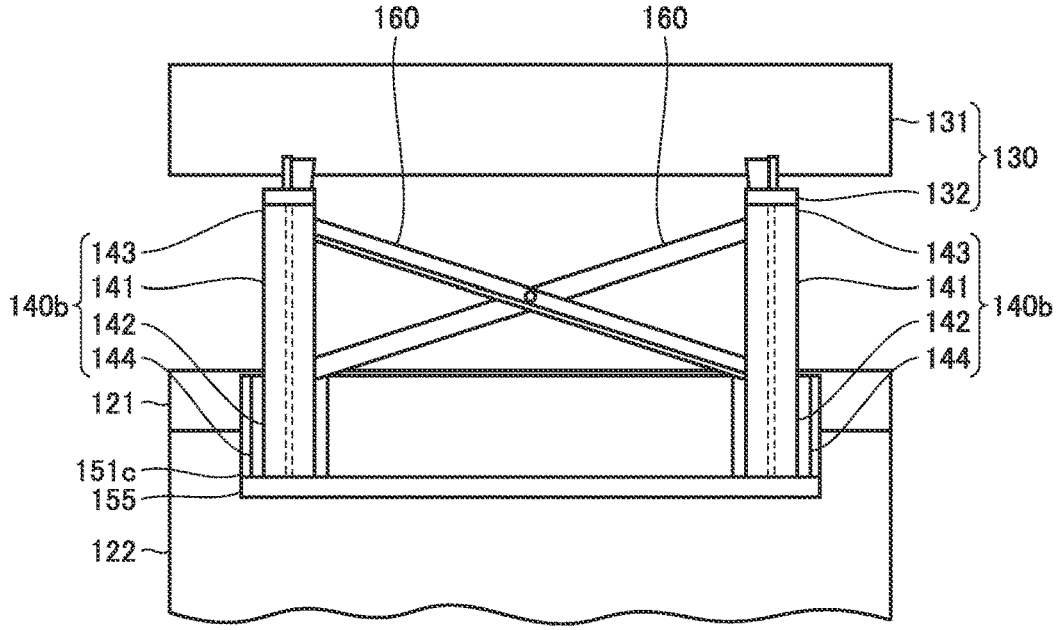
FIG. 14 is a partial side view illustrating the transformer in FIG. 13 as viewed from a direction of an arrow XIV.

FIG. 13 is a partial front view illustrating a configuration of the transformer of the fourth embodiment of the present invention. FIG. 14 is a partial side view illustrating the transformer in FIG. 13 as viewed from a direction of an arrow XIV.

As illustrated in FIGS. 13 and 14, the transformer of the fourth embodiment of the present invention includes two support fittings 140*b* and one mounting seat 150*c*. Two support fittings 140*b* are attached to one mounting seat 150*c*. An engagement unit 155 that positions support fitting 140*b* and mounting seat 150*c* is provided on mounting seat 150*c*.

Specifically, mounting seat 150*c* includes a flat plate 151*c* and a leg. Flat plate 151*c* extends in the width direction, and contacts with flat plates 144 of two support fittings 140*b*. Mounting seat 150*c* further includes engagement unit 155 protruding from flat plate 151*c* toward the side contacting with support fitting 140*b*. Engagement unit 155 extends in the width direction at a position of the lower end of flat plate 151*c*. Engagement unit 155 has a rectangular parallelepiped shape, and is bonded to flat plate 151*c* by welding. The shape of engagement unit 155 is not limited to the rectangular parallelepiped, but may be a columnar shape. Mounting seat 150*c* may be formed of one member by casting or cutting.

In attaching two support fittings 140*b* to mounting seat 150*c*, the lower ends of flat plates 144 of two support fittings 140*b* are brought into contact with the upper surface of engagement unit 155, which allows two support fittings 140*b* to be positioned in the height direction with respect to mounting seat 150*c*.

When two support fittings 140*b* are attached to one mounting seat 150*c*, two support fittings 140*b* have no influence of the displacement between the mounting seats in the case where the plurality of mounting seats are used, so that two support fittings 140*b* are disposed with high accuracy.

Thus, in the transformer of the fourth embodiment, support fitting 140*b* can be disposed with high precision while easily positioned with respect to mounting seat 150*c*. As a result, conservator 130 can be disposed with high accuracy with respect to tank 120.

The engagement unit that positions support fitting 140*b* and mounting seat 150*c* may be provided on flat plate 144 of support fitting 140*b*, or provided on both flat plate 144 of support fitting 140*b* and flat plate 151*c* of mounting seat 150*c*. Two support fittings 140*b* may be attached to two mounting seats in a one-to-one manner, and engagement unit 155 may be provided on each of the two mounting seats.

Fifth Embodiment

A transformer according to a fifth embodiment of the present invention will be described below with reference to the drawings. Because the transformer of the fifth embodiment of the present invention differs from transformer 100 of the first embodiment of the present invention only in the configuration of the mounting seat, the description of the same configuration as transformer 100 of the first embodiment of the present invention will not be repeated.

Figure 15:
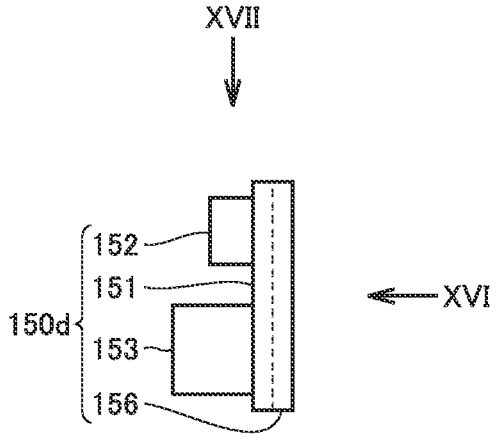
FIG. 15 is a front view illustrating a configuration of the mounting seat included in a transformer according to a fifth embodiment of the present invention.
Figure 16:
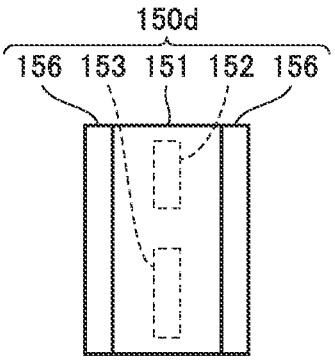
FIG. 16 is a side view illustrating the transformer in FIG. 15 as viewed from a direction of an arrow XVI.
Figure 17:
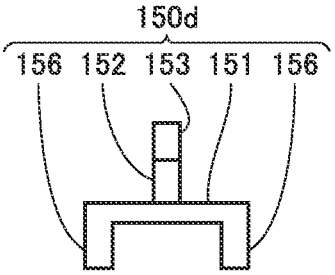
FIG. 17 is a plan view illustrating the transformer in FIG. 15 as viewed from a direction of an arrow XVII.

FIG. 15 is a front view illustrating a configuration of the mounting seat included in the transformer of the fifth embodiment of the present invention. FIG. 16 is a side view illustrating the transformer in FIG. 15 as viewed from a direction of an arrow XVI. FIG. 17 is a plan view illustrating the transformer in FIG. 15 as viewed from a direction of an arrow XVII.

As illustrated in FIGS. 15 to 17, a mounting seat 150*d* included in the transformer of the fifth embodiment of the present invention includes a protrusion 156 protruding from at least a part of the periphery of flat plate 151 toward the side contacting with support fitting 140. In the fifth embodiment, protrusions 156 extend in the vertical direction on both sides in the width direction of flat plate 151. Flat plate 151 and protrusion 156 are formed of one member. However, flat plate 151 and protrusion 156 may be formed of different members, and may be bonded together by welding. Protrusion 156 has higher strength and rigidity by including protrusion 156.

Figure 18:
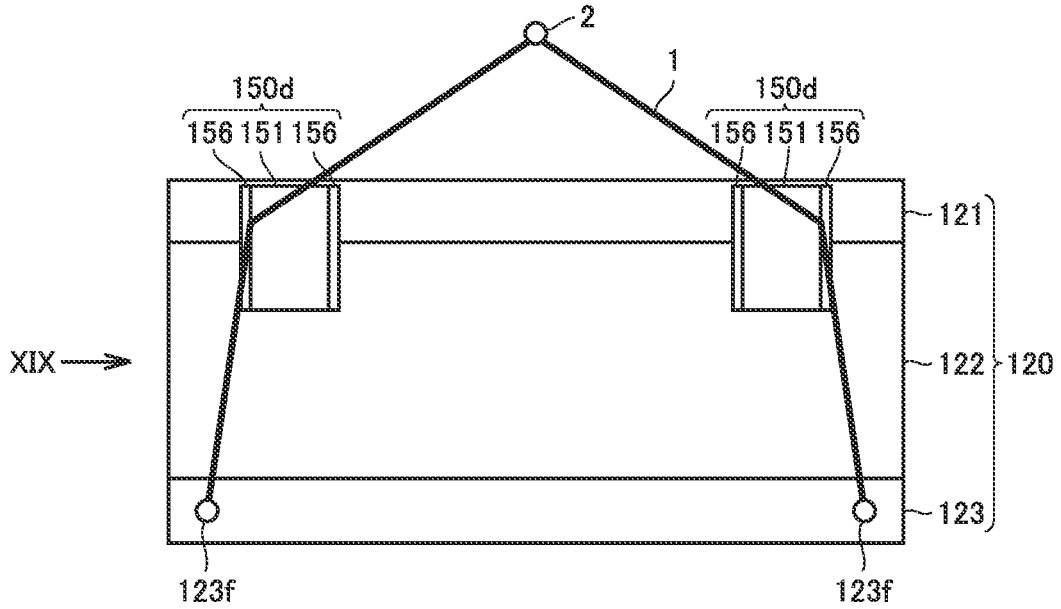
FIG. 18 is a side view illustrating a state in which the transformer of the fifth embodiment of the present invention is hung up using a wire before the support fitting is attached to the mounting seat.
Figure 19:
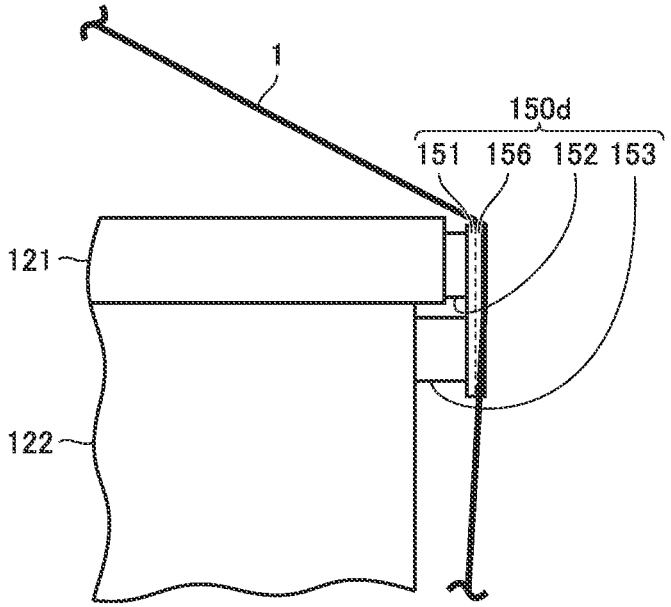
FIG. 19 is a partial front view illustrating a state in which the transformer in FIG. 18 is hung up as viewed from a direction of an arrow XIX.

FIG. 18 is a side view illustrating a state in which the transformer of the fifth embodiment of the present invention is hung up using a wire before the support fitting is attached to the mounting seat. FIG. 19 is a partial front view illustrating a state in which the transformer in FIG. 18 is hung up as viewed from a direction of an arrow XIX.

As illustrated in FIGS. 18 and 19, when the transformer of the fifth embodiment of the present invention is hung up with a wire 1, wire 1 is connected to a latching unit 123*f* at two locations provided on one side surface of lower tank 123. Other wires are connected to two latching units (not illustrated) provided on the other side surface of lower tank 123. The transformer is hung up by lifting wire 1 and other wires using a hand strap 2 of a crane.

When the transformer is hung up as described above, wire 1 comes into contact with protrusion 156 of mounting seat 150*d*, and becomes a bent state. For this reason, when the transformer is hung up, a large load is applied to mounting seat 150*d*. The strength and the rigidity of mounting seat 150*d* of the fifth embodiment are enhanced because mounting seat 150*d* includes protrusion 156, so that mounting seat 150*d* can be prevented from being deformed when the transformer is hung up. The position of protrusion 156 on mounting seat 150*d* is appropriately set according to the contact position between wire 1 and mounting seat 150*d*.

In the description of the above embodiments, configurations that can be combined may be combined with each other.

It should be noted that the above embodiments disclosed herein is merely an example in all respects, and are not a basis for restrictive interpretation. Thus, the technical scope of the present invention is not interpreted only by the above embodiments, but is defined based on the description of the claims. Further, the meaning equivalent to the claims and all changes within the claims are included.

REFERENCE SIGNS LIST

1: wire, 2: hand strap, 100: transformer, 110: transformer body, 111: iron core, 112: winding, 120: tank, 121: upper tank, 122: middle tank, 123: lower tank, 123*f*: latching unit, 130: conservator, 131: conservator body, 132: leg, 140, 140*b*: support fitting, 141: main unit, 142: lower end, 143: upper end, 144, 151, 151*b*, 151*c*: flat plate, 150, 150*a*, 150*b*, 150*c*, 150*d*: mounting seat, 151*h*: through-hole, 152, 152*b*: upper leg, 153, 153*b*: lower leg, 154*a*, 154*b*: rib, 155: engagement unit, 156: protrusion, 160: brace, 170: iron core presser, 180: external lead, 190: bolt, 191: nut

The invention claimed is:

1. A transformer comprising:

a transformer body including an iron core and a winding;

a tank including an upper tank, a middle tank, and a lower tank, which are bonded to one another to constitute an internal space accommodating the transformer body;

a conservator disposed at a position above the tank;

a plurality of support fittings arranged side by side at an interval from each other to support the conservator; and at least one mounting seat bonded to both a peripheral wall of the upper tank and a peripheral wall of the middle tank and fixed to the tank, the plurality of support fittings being attached to the mounting seat.

2. The transformer according to claim 1, wherein the plurality of support fittings are detachably attached to the mounting seat.

3. The transformer according to claim 2, wherein an engagement unit positioning the plurality of support fittings and the mounting seat is provided in the plurality of support fittings or the mounting seat.

4. The transformer according to claim 1, further comprising an iron core presser bonded to an inner peripheral surface in an upper portion of the peripheral wall of the middle tank to sandwich the iron core, wherein the mounting seat facing the iron core presser with the peripheral wall of the middle tank interposed therebetween.

5. The transformer according to claim 1, wherein the mounting seat includes a flat plate contacting with the support fitting and a leg provided upright from an opposite side to a side contacting with the support fitting with respect to the flat plate, the leg contacting with both the peripheral wall of the upper tank and the peripheral wall of the middle tank.

6. The transformer according to claim 5, wherein the mounting seat further includes a protrusion protruding from at least a part of a periphery of the flat plate toward a side contacting with the support fitting.

7. The transformer according to claim 1, comprising a plurality of the mounting seats, wherein the plurality of support fittings being attached to the plurality of mounting seats in a one-to-one manner.

8. The transformer according to claim 1, comprising the one mounting seat, wherein the plurality of support fittings are attached to the one mounting seat.

* * * * *